US006432559B1

(12) United States Patent
Tompkins et al.

(10) Patent No.: US 6,432,559 B1
(45) Date of Patent: Aug. 13, 2002

(54) TAMPER-PROOF IDENTIFICATION OF SOLID OBJECTS

(75) Inventors: Dana D. Tompkins, Broomfield; Charles E. Tompkins, Brighton, both of CO (US)

(73) Assignee: Applied Technologies & Fabrication, Inc., Longmont, CO (US)

( * ) Notice: Subject to any disclaimer, the term of this patent is extended or adjusted under 35 U.S.C. 154(b) by 0 days.

(21) Appl. No.: 09/591,937

(22) Filed: Jun. 12, 2000

(51) Int. Cl.[7] ..... B32B 15/00; B32B 15/04; F41C 27/00

(52) U.S. Cl. ..... 428/624; 428/668; 428/457; 428/916; 42/1.01

(58) Field of Search ..... 428/624, 668, 428/457, 916; 42/1.01

(56) References Cited

U.S. PATENT DOCUMENTS 4,019,053 A 4/1977 Levine
4,222,330 A * 9/1980 Krystyniak
4,445,225 A 4/1984 White
4,605,847 A 8/1986 Schittko et al.
4,749,847 A 6/1988 Despres
4,764,948 A 8/1988 Hurwitz
5,115,461 A 5/1992 Kranz et al.
5,416,486 A 5/1995 Koert et al.
5,485,789 A * 1/1996 Collier
5,511,483 A 4/1996 Griffin, Jr.
5,632,108 A 5/1997 Ruger et al.
5,698,816 A * 12/1997 Roxby
6,293,204 B1 * 9/2001 Regen

* cited by examiner

*Primary Examiner*—Deborah Jones
*Assistant Examiner*—Jason L Savage
(74) *Attorney, Agent, or Firm*—Harold A. Burdick

(57) ABSTRACT

Identification markers and identification methods for solid objects, including metallic objects, are disclosed, the marker integrated with the object so that it is neither optically visible nor removable without destruction or impairment of the object. The marker is more radio opaque than the base material forming the object in the region of marker location and includes an identifying indicia thereon.

8 Claims, 2 Drawing Sheets

TAMPER-PROOF IDENTIFICATION OF SOLID OBJECTS

FIELD OF THE INVENTION

This invention relates to identification marking and, more particularly, relates to means and methods for permanently relating an identification marking with a solid object.

BACKGROUND OF THE INVENTION

Serial numbers or other identifying markings have been associated with various objects in order to track and identify such objects. For example, motor vehicle engines, firearms, and other items are often required to be produced with serial numbers. The serial numbers are required by licensing and public safety authorities to enable ownership and origin of such items to be documented and followed.

Typically, serial numbers of this type have been produced on a plate attached to the item or been stamped in the item or mold, and thus are visible to the naked eye. Where the item is polymer based, metal identification bearing tags are now inserted at the surface of the item and are, likewise, visible to the naked eye (see, for example, U.S. Pat. No. 5,632,108). In either case, this form of marking an item is subject to corruption, whether by intentional tampering or by environmental factors such wear or corrosion. Since one basic method for ownership and/or origin identification of many items has been by matching of a serial number visible by optical or surface profiling methods to a record, identification can be made nearly impossible in such cases.

Various mechanisms providing more covert systems of identification have been proposed (see, for example, U.S. Pat. Nos. 4,749,847, 4,019,053, 5,511,483, and 4,445,225). These mechanisms, while undoubtedly effective, are of somewhat limited application due to their complexity and therefore expense, lack of adaptability to current common record keeping systems now, and for the foreseeable future, in use, lack of information carrying capacity, and/or imperfect concealment. Further improvement, particularly directed to providing tamper-proof identification that is adaptable to current common systems of identification and record keeping and that is an, integral part of item manufacture, could thus still be utilized.

SUMMARY OF THE INVENTION

This invention provides molded or cast objects including remotely detectable identification markers, and methods for tamper-proof identification of solid objects and substantially permanent location of identification indicia in molded or cast objects. The devices and methods of this invention utilize tamper-proof identification means that are readily adaptable to current common systems of identification and record keeping and that are an integral part of object manufacture. The devices and methods are relatively simple to produce and use, thus avoiding undue expense, and provide relatively large information carrying capacity. Markers in accord with this invention, when located in objects, are perfectly optically concealed.

The molded or cast object of this invention is provided with substantially permanent identification marking included within a solid molded or cast portion formed of a first material. A marker having a formation indicative of selected data is located, when the solid portion is molded or cast, so that the marker is entirely surrounded by the first material of the solid portion. The marker includes or is formed from a constituent material having an atomic number greater than any constituent of the first material forming the solid portion of the object.

The marker may be a thin film insert positioned in the mold before molding or casting of the solid portion of the object. For example, a polymer based thin film having the constituent material thereon could be utilized. The constituent material is preferably a noble metal, particularly where the first material of the solid portion includes a metallic constituent.

Where the molded or cast object includes a functional structure, the solid portion having the marker therein is preferably a part of or located adjacent to the functional structure so that any effort to corrupt the marker degrades the functional structure. By the foregoing means, the formation at the marker is remotely detectable (or readable) using, for example, means operable by principals of energy adsorption, while the marker is neither optically visible nor readily physically accessible to a user of the object.

The methods for substantially tamper-proof identification of a molded or cast object include the steps of establishing a formation indicative of selected data at a marker, with the marker or the formation including material having an atomic number greater than any constituent of the base material forming the object in the region of marker location. The marker is located in a mold before the object is molded or cast in the mold so that the marker is entirely surrounded by the first material of the object when molded or cast. Thus, the formation is detectable through the first material of the object by selected means yet the marker is neither optically visible nor readily physically accessible to a user of the object. The marker is preferably located in the mold at a position so that efforts to corrupt the marker will degrade a functional structure of the object.

In the particular case of firearm identification markings (serial numbers, typically), the invention uses methods of identification which do not rely on surface morphology to identify the firearm. The identification marker, or tag, is made from material that is more radio-opaque than the base material of the firearm or portion thereof where installed. In the case of a polymer firearm, any material that has an atomic number greater than that of carbon could be used, though metals would be most effective. In the case of aluminum firearms, any metal that has an atomic number greater than that of aluminum would be most effective. The same basic calculation holds true for steel (iron alloys) or titanium firearms. While the only requirement is that the marker be made of a material which is more radio opaque than the base material, though material with a higher atomic number will provide a marker more readily identifiable in the firearm base material.

It is therefore an object of this invention to provide substantially tamper-proof, and thus permanent, identification for solid objects.

It is another object of this invention to provide markers and methods for tamper-proof identification of solid objects including firearms.

It is another object of this invention to provide markers and methods for tamper-proof identification of solid objects embodying improvements directed to adaptability to current common systems of identification and record keeping and integration with item manufacture.

It is still another object of this invention to provide markers and methods for identification of solid objects wherein location and presence of an identifying marking is not optically detectable.

It is still another object of this invention to provide markers and methods for identification of solid objects wherein location of an identifying marking is selected so that efforts to corrupt the marking diminish utility of the object.

It is yet another object of this invention to provide a molded or cast object with substantially permanent identification marking comprising a solid molded or cast portion formed of a first material, and a marker having a formation thereat indicative of selected data, the marker including at least a constituent material having an atomic number greater than any constituent of the first material, and the marker being located when the solid portion is molded or cast so that the marker is entirely surrounded by the first material of the solid portion.

It is still another object of this invention to provide a marker for molding or casting within a solid object comprising a thin film insert.

It is yet another object of this invention to provide a method for substantially tamper-proof identification of a molded or cast object formed of a first material that includes the steps of establishing a formation indicative of selected data at a marker, at least one of the marker and the formation including material having an atomic number greater than any constituent of the first material, and locating the marker in a mold before the object is molded or cast in the mold so that the marker is entirely surrounded by the first material of the object when molded or cast, whereby the formation is detectable through the first material of the object by selected means but the marker is neither optically visible nor readily physically accessible to a user of the object.

It is still another object of this invention to provide a method for making a molded or cast object including a functional structure at or adjacent to a solid portion, the solid portion formed of a first material, the object having substantially permanent identification marking, the method including the steps of establishing a formation on a thin film marker indicative of selected data, one of the formation and the marker including a constituent material having an atomic number greater than any constituent of the first material, locating the marker in a mold at a position corresponding to the solid portion before the solid portion is molded or cast in the mold, and molding or casting the solid portion in the mold around the marker, whereby the marker is located relative to the functional structure so that an effort to corrupt the marker degrades the functional structure.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
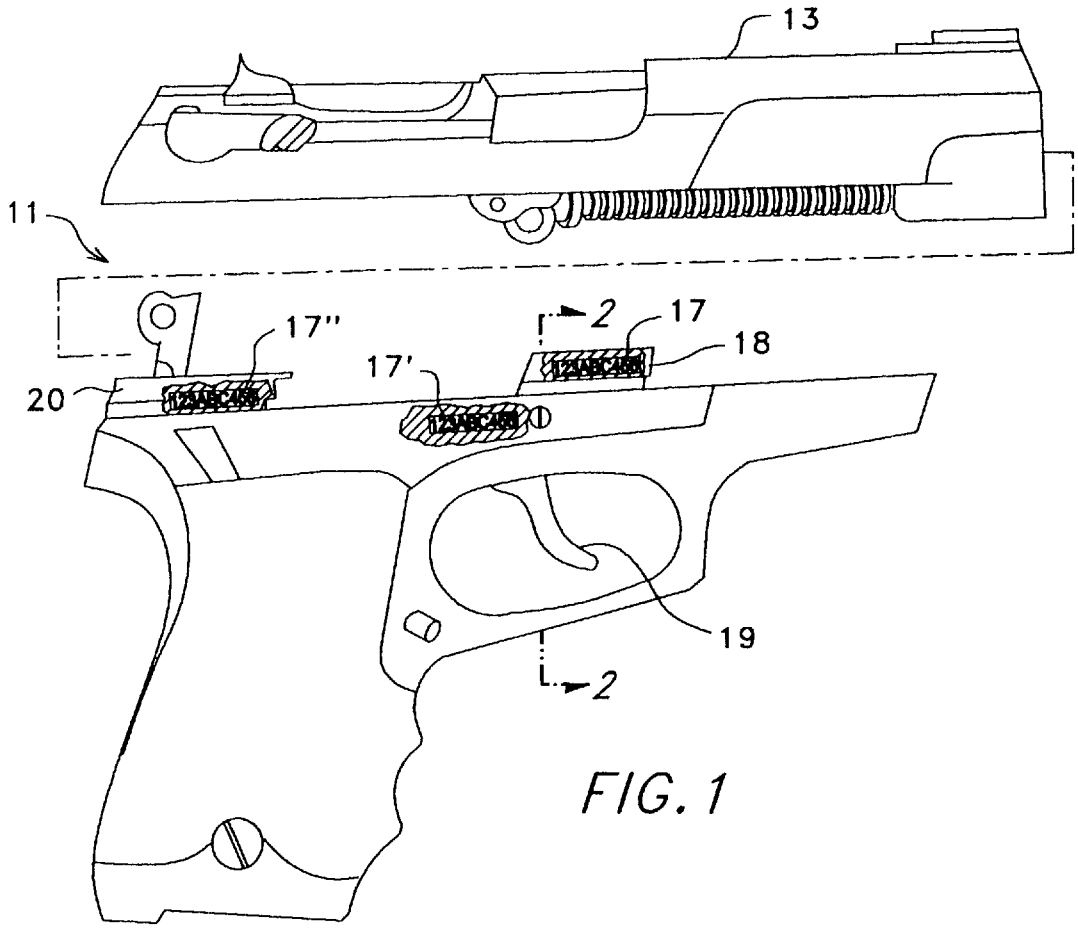
FIG. 1 is an exploded side view illustration with cut-away portions showing a molded or cast object of this invention (a firearm, by way of example) having an identification marker of this invention incorporated thereinto.
Figure 2:
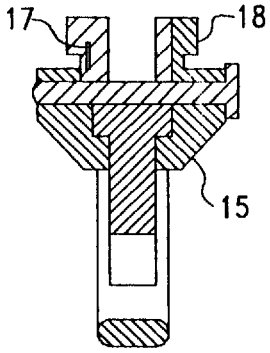
FIG. 2 is a sectional view taken through section lines 2—2 of FIG. 1.

While the identification markers and methods of this invention may be utilized with a wide variety objects having solid molded or cast portions (or even laminates), FIGS. 1 and 2 show their use with a firearm 11 (one particularly advantageous application of the principals of this invention). A typical firearm 11, including slide 13 and frame body 15 has heretofore been provided with a surface inscribed serial number positioned at a frame body 15 as prescribed by regulation. The identifying serial numbers on firearms consist of a combination of numbers and letters in a system well known and widely utilized by both manufacturers and various agencies to identify ownership and origin of the weapon.

Marker 17 of this invention is imbedded in the firearm at the time of manufacture of the weapon as hereinafter set forth, and is preferably positioned at frame 15, a solid molded or cast structure (though it could be placed in any other molded or cast portion of the firearm, and may be placed anywhere in the frame). Since frame 15 establishes the framework for all other parts of the firearm (such as slide 13) and/or is integral to such parts, functional structures effecting operation of the firearm, such as slide support 18, are positioned in close proximity to frame 15. Location of marker 17 in frame 15 immediately adjacent to such functional structures discourages efforts at corruption of the marker (by, for example, grinding, drilling or gouging of the frame to corrupt the marker) due to the likelihood of damage (for example to slide support 18) by such an undertaking to the operability of firearm 11.

For purposes of illustration only, other (alternative) examples of positioning of a marker such as 17 at other critical positions imbedded in frame 15 are shown in FIG. 1 (it being understood that, typically, only a single serial number on the frame at a single location is required). Marker 17' could be positioned on frame 15 in a location adjacent to mechanisms associated with operation of trigger 19. On many models of firearms, such location would result in damage to the trigger mechanism were intentional corruption of the marker attempted. Likewise, marker 17" could be positioned adjacent hammer bar 20 where attempts to corrupt the marker would lead to failure of support for the firearm hammer mechanism and/or sear.

Figure 3:
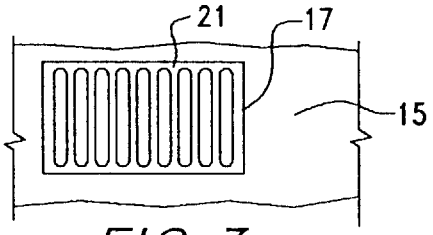
FIGS. 3 and 4 are reproductions of x-ray images of an imbedded identification marker, the marker imbedded in a metallic object.
Figure 4:
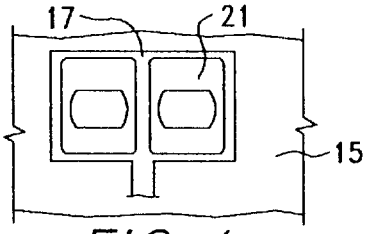
Figure 5A:
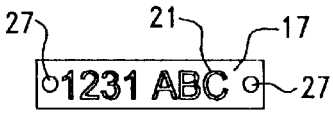
FIGS. 5A through 5G are illustrations of an example of one process of making a molded or cast object with tamper-proof identification in accord with the methods of this invention.
Figure 5B:
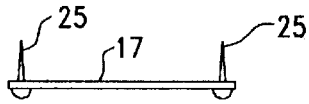
Figure 5C:
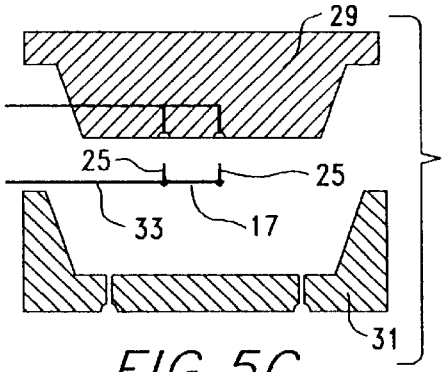
Figure 5D:
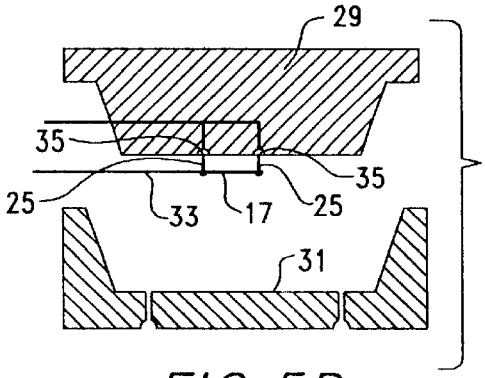
Figure 5E:
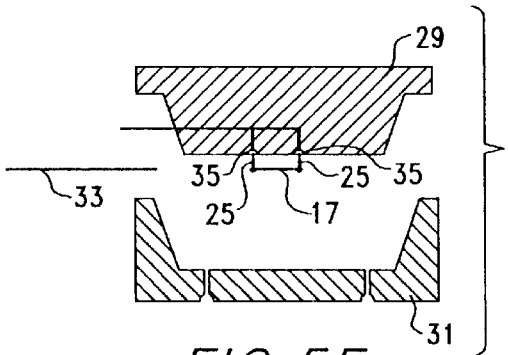
Figure 5G:
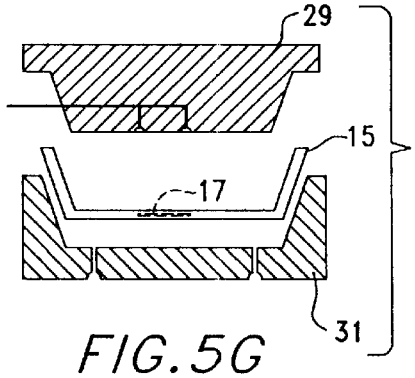
Figure 5F:
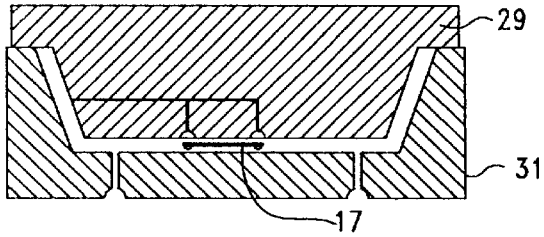

Marker 17 is provided with formation 21 at a surface thereof indicative of selected data, including the weapon's serial number (see FIGS. 3 and 4 for illustration). Formation 21 may be the very same presentation (i.e., a number and letter combination system) currently utilized by manufacturer's and agencies with respect to surface inscribed serial numbers.

Markers 17, and particularly formation 21 thereof, may be made of a variety of materials compatible with the particular manufacturing process and the base material of the host object (firearm 11, for example) so long as the material (or a constituent thereof) is more radio opaque than the base material of the host object. Certain metals however, and particularly noble metals such as platinum, are preferable. Noble metals have a high atomic number and provide the distinct advantage of resistance to corrosion. While noble metals are preferred, any constituent material of higher atomic number than the host object material (or constituents thereof) in the region where the marker is imbedded can be used.

Marker 17 is permanently embedded within the base material of firearm 11 by insertion thereof into a mold before molding or casting of frame 15 of firearm 11. After frame 15 is mold or cast, marker 17 is entirely surrounded by the base material of frame 15, and thus is neither visible by optical means nor readily physically accessible to a user of firearm 11 (i.e., its location is not readily known except to the manufacturer). This fact alone will prevent most tampering with the identifying markers.

As illustrated by the x-ray image reproductions of FIGS. 3 and 4, markers 17 function using principles of energy adsorption. An energy source, such a x-rays, is passed through the base material of frame 15 of firearm 11, with energy sufficient that frame 15 is lightly penetrated by the energy source. As shown, identifying markers 17, being made of, or having surface formation 21 made of, a more radio opaque material or materials, adsorbs more of the energy than the base material, resulting in image formation utilizing known technology. Marker 17 and/or surface formation 21 can be formed to provide varying degrees of radio opaqueness utilizing a variety of constituent materials and/or material thickness' so that image formation can provide even more data (see FIG. 4). In the specific case of x-ray penetration, the identifying marker and/or surface formations will look darker than the surrounding material. Thus, serial numbers and/or other data will be readily detectable and readable even in their conventional and widely used format (though other formats, such as bar codes for example, may be used). Firearms may thereby be provided with substantially permanent and tamper-proof ownership and origin identification without a change to current record keeping models.

Many known manufacturing methods may be utilized to produce the markers of this invention. Marker 17 and formation 21 may be produced, for example, by etching data (serial number, bar code or the like) on the surface of a thin film material either mechanically, chemically, or with energy (laser or EDM). Another method for making the markers, for example, is by sputter coating a polymer thin film with a metal and using a mask to produce regions with varying amounts of coating corresponding to a selected formation 21. Alternatively, the coating could be applied evenly and then removed from the polymer surface in selected patterns as discussed above. Moreover, using sputtering techniques for example, plural formations 21 using different metals could be formed at marker 17.

In cases where a reinforcement such as FIBERGLASS, KEVLAR, or carbon is used in the manufacture of the object, the mat or cloth used in such reinforcement systems can have the identifying mark applied directly thereto by sputter coating and/or etching of formation 21 thereat, the mat or cloth itself essentially functioning in such case as the marker.

It should be appreciated that this invention is not limited to use with firearms, and can be usefully employed with a variety of objects such a aircraft parts, automobile parts, or any part or item that is molded, casted, laminated, or of like manufacture and that requires serialization or identification marking, numbers, symbols or characters.

Elements that can be used, either in pure form or in alloyed form, to make the markers for a polymer manufacture (i.e., firearm frame) include any of the following (generally having an atomic number greater than 6): actinium, aluminum, americium, antimony, arsenic, astatine, barium, berkelium, bismuth, bohrium, cadmium, calcium, californium, cerium, cesium, chromium, cobalt, copper, curium, dubnium, dysprosium, einsteinium, erbium, europium, fermium, francium, gadolinium, gallium, germanium, gold, halfnium, hassium, holmium, indium, iodine, iridium, iron, lanthanum, lawrencium, lead, lutetium, magnesium manganese, meitnenium, mendelevium, mercury, molybdenum, neodymium, neptunium, nickel, niobium, nobelium, osmium, palladium, phosphorus, platinum, plutonium, polonium, potassium, praseodymium, promethium, protactinium, radium, rhenium, rhodium, rubidium, ruthenium, rutherfordium, samarium, scandium, seaborgium, selenium, silicon, silver, sodium, stronium, sulfur, tantalum, technetium, tellurium, terbium, thallium, thorium, thulium, tin, titanium, tungsten, uranium, vanadium, ytterbium, yttrium, zinc, or zirconium.

Elements that can be used, either in pure form or in alloyed form, to make the markers for an aluminum manufacture (i.e., firearm frame) include any of the following (generally having an atomic number greater than 13): actinium, americium, antimony, arsenic, astatine, barium, berkelium, bismuth, bohrium, cadmium, calcium, californium, cerium, cesium, chromium, cobalt, copper, curium, dubnium, dysprosium, einsteinium, erbium, europium, fermium, francium, gadolinium, gallium, germanium, gold, halfnium, hassium, holmium, indium, iodine, iridium, iron, lanthanum, lawrencium, lead, lutetium, manganese, meitnenium, mendelevium, mercury, molybdenum, neodymium, neptunium, nickel, niobium, nobelium, osmium, palladium, phosphorus, platinum, plutonium, polonium, potassium, praseodymium, promethium, protactinium, radium, rhenium, rhodium, rubidium, ruthenium, rutherfordium, samarium, scandium, seaborgium, selenium, silicon, silver, stronium, sulfur, tantalum, technetium, tellurium, terbium, thallium, thorium, thulium, tin, titanium, tungsten, uranium, vanadium, ytterbium, yttrium, zinc, or zirconium.

Elements that can be used, either in pure form or in alloyed form, to make the markers for a steel (iron-based alloy) manufacture (i.e., firearm frame) include any of the following (generally having an atomic number greater than 26): actinium, americium, antimony, arsenic, astatine, barium, berkelium, bismuth, bohrium, cadmium, californium, cerium, cesium, cobalt, copper, curium, dubnium, dysprosium, einsteinium, erbium, europium, fermium, francium, gadolinium, gallium, germanium, gold, halfnium, hassium, holmium, indium, iodine, iridium, lanthanum, lawrencium, lead, lutetium, meitnenium, mendelevium, mercury, molybdenum, neodymium, neptunium, nickel, niobium, nobelium, osmium, palladium, platinum, plutonium, polonium, praseodymium, promethium, protactinium, radium, rhenium, rhodium, rubidium, ruthenium, rutherfordium, samarium, seaborgium, selenium, silver, stronium, tantalum, technetium, tellurium, terbium, thallium, thorium, thulium, tin, tungsten, uranium, ytterbium, yttrium, zinc, or zirconium.

Elements that can be used, either in pure form or in alloyed form, to make the markers for a titanium manufacture (i.e., firearm frame) include any of the following (generally having an atomic number greater than 22):actinium, americium, antimony, arsenic, astatine, barium, berkelium, bismuth, bohrium, cadmium, californium, cerium, cesium, chromium, cobalt, copper, curium, dubnium, dysprosium, einsteinium, erbium, europium, fermium, francium, gadolinium, gallium, germanium, gold, halfnium, hassium, holmium, indium, iodine, iridium, iron, lanthanum, lawrencium, lead, lutetium, manganese, meitnenium, mendelevium, mercury, molybdenum, neodymium, neptunium, nickel, niobium, nobelium, osmium, palladium, platinum, plutonium, polonium, praseodymium, promethium, protactinium, radium, rhenium, rhodium, rubidium, ruthenium, rutherfordium, samarium, seaborgium, selenium, silver, stronium, tantalum, technetium, tellurium, terbium, thallium, thorium, thulium, tin, tungsten, uranium, vanadium, ytterbium, yttrium, zinc, or zirconium.

Marker 17 is preferably produced as a thin film insert for insertion in the matrix of the parent material of the object. This is done, in the case of polymers, using supports built into the mold as set forth below. In the case of metal casting, the markers could be supported on thin wire with the same composition as the parent material of the portion into which the marker is to be molded. Upon casting, sintering, or other solidification process, the thin wire would melt and become part of a homogeneous matrix surrounding the marker. Some alloying between the parent metal and the identifying marker may occur at the margins of the marker, but would not effect marker readability.

FIGS. 5A through 5G show a typical production method for embedding the marker that is applicable with either thermoplastic injection molding processes or powder metallurgical processes. Injection molding normally uses a thermoplastic and this method is best suited for a thermoplastic although it can be modified for use with a thermosetting plastic.

Connecting devices 25 (shown a rivets in the drawing) are of minimal size and are made from the same material as the base polymer to be used in the object (for example, firearm frame 15, which is shown representationally in the drawings and utilized only for purposes of description of the process). When used with a powder metallurgical process, the connecting devices would be made of the same material as the host metal carrier polymer.

After marker 17 is made and formation 21 established, small holes 27 are formed through the markers to hold connecting devices 25. The markers are brought into position between mold halves 29 and 31 using placement device 33 such as a stiff wire or other mechanical holder. The ends of connecting devices 25 are brought into contact momentarily with heat spots 35 on mold half 29 in an automated process (for example, spots 35 may be created by precisely located metal wires connected to an outside voltage source). Heated spots 35 cause the devices 25 to stick at the surface of mold half 29.

Placement device 33 is then released from marker 17 and removed from between mold halves 29 and 31. The two mold halves are brought together and a polymer or a polymer/metal mixture (for powder metallurgical processes) is injected into the mold. The heated polymer or polymer mixture causes marker holding devices 25 to melt, becoming a part of the continuous polymer matrix. Molded frame piece 15 having marker 17 imbedded therein and entirely surrounded by the polymer matrix is ejected from the mold and the process begins again.

As may be appreciated from the foregoing, identification marker tamper-resistance, data carrying capacity, and permanence are all substantially benefited utilizing the improvements characterizing this invention.

What is claimed is:

1. A molded or cast object with substantially permanent identification marking comprising:

a solid molded or cast portion formed of a first material;

a marker having a formation thereat indicative of selected data, said marker including at least a constituent material having an atomic number greater than any constituent of said first material, and said marker being located when said solid portion is molded or cast so that said marker is entirely surrounded by said first material of said solid portion.

2. The molded or cast object of claim 1 wherein said marker is a thin film insert.

3. The molded or cast object of claim 2 wherein said thin film insert is a polymer based thin film having said constituent material thereat.

4. The molded or cast object of claim 1 wherein said constituent material is a noble metal.

5. The molded or cast object of claim 1 wherein said first material of said solid portion includes metallic constituent.

6. The molded or cast object of claim 1 wherein said object further comprises a functional structure at or adjacent to said solid portion, said marker located relative to said functional structure so that efforts to corrupt said marker degrade said functional structure.

7. The molded or cast object of claim 6 wherein said solid portion is a frame of a firearm, wherein said functional structure is one of a slide, a hammer, a sear, and a trigger mechanism of a firearm, and wherein said marker is located at said frame at support members for said functional structure.

8. The molded or cast object of claim 1 wherein said formation at said marker is remotely detect-and wherein said marker is neither optically visible nor readily physically accessible to a user of said object.

* * * * *